US007175025B2

(12) United States Patent
Chum

(10) Patent No.: US 7,175,025 B2
(45) Date of Patent: Feb. 13, 2007

(54) CONVENIENCE PACKAGE FOR THIN FILM PRODUCTS

(76) Inventor: Tung Hang Chum, Flat D, 8/F, Leapont Industrial Bldg., 18-28 Wo Liu Hang Road Fo Tan, Shatin, New Territories, Hong Kong (CN)

( * ) Notice: Subject to any disclaimer, the term of this patent is extended or adjusted under 35 U.S.C. 154(b) by 242 days.

(21) Appl. No.: 10/993,064

(22) Filed: Nov. 19, 2004

(65) Prior Publication Data

US 2005/0252819 A1 Nov. 17, 2005

(30) Foreign Application Priority Data

May 11, 2004 (CN) ..... 200410027130
May 11, 2004 (CN) ..... 200420045597

(51) Int. Cl.
*B65D 1/34* (2006.01)

(52) U.S. Cl. ..... 206/554; 206/449; 206/494; 206/499; 221/64; 221/32; 221/33; 383/32

(58) Field of Classification Search ..... 206/449, 206/494, 499, 554, 804, 390; 221/64, 32, 221/33, 46, 45, 63, 49; 383/32
See application file for complete search history.

(56) References Cited

U.S. PATENT DOCUMENTS

| | | | | |
|---|---|---|---|---|
| 4,624,365 | A * | 11/1986 | Derdyk | 206/554 |
| 5,509,570 | A * | 4/1996 | DeMatteis | 221/33 |
| 5,688,394 | A * | 11/1997 | McBride et al. | 206/233 |
| 6,269,972 | B1 * | 8/2001 | Smithson | 221/33 |
| 6,571,984 | B1 * | 6/2003 | Winesett | 221/36 |
| 6,655,546 | B1 * | 12/2003 | Bolton et al. | 221/45 |
| 6,716,296 | B2 | 4/2004 | Chum | 156/290 |
| 2003/0111381 | A1 * | 6/2003 | Borrisuttanakul | 206/554 |

* cited by examiner

*Primary Examiner*—Mickey Yu
*Assistant Examiner*—Steven A. Reynolds
(74) *Attorney, Agent, or Firm*—Alix, Yale & Ristas, LLP

(57) ABSTRACT

A convenience package for thin film products according to aspects of the present invention places a folded stack of thin film plastic bags inside a container to protect the bags during shipping, handling and dispensing. The container surrounds the plastic bags and includes an opening through which individual bags are retrieved. The plastic bags are attached to each other in such a manner that retrieval of a first bag through the opening in the container partially retrieves a second bag and leaves part of the second bag protruding through the opening. Attachments between bags within the container ensure that each bag is opened as it is retrieved through the opening.

9 Claims, 1 Drawing Sheet

CONVENIENCE PACKAGE FOR THIN FILM PRODUCTS

BACKGROUND OF THE INVENTION

1. Field of the Invention

The present invention relates to the dispensing of plastic bags and more particularly to a dispensing arrangement of plastic bags that protects the bags before dispensing and from which bags are dispensed open and individually.

2. Description of the Related Art

Plastic bags have become the preferred means for packaging goods sold in shops and markets throughout the world. As manufacturing techniques become more sophisticated, bags have become extremely thin, complicating their storage, dispensing and use. Currently, it is known to stack multiple thin film plastic bags and bond them together at one or more points so that the assembled stack of bags can be stored and displayed neatly. The bonded portions may be part of a bag root from which each bag breaks away at perforations between the bag and bag root.

Typically, the consumer or clerk grasps any convenient portion of the bag and exerts pulling force to break the perforations and separate a bag from the bag toot. This motion does not usually open the bag. The thin film from which bags are constructed is inherently flimsy and prone to static charge. The limp nature of the film combined with static charges cause the inner layers of the bag to cling together, making opening of the bag inconvenient and time consuming. Frequently, opening the bag requires extensive manipulation that potentially contaminates the bag. Additionally, the user frequently grasps and retrieves more than one bag. This often results in unused bags being thrown away.

U.S. Pat. No. 6,716,296 discloses an arrangement in which the bags are provided with a low-melt temperature outside layer. This outside layer allows stacked bags to be bonded together at adjacent outside surfaces, while the inside surfaces of the bags remain free of each other. This feature connects successive bags in a stacked arrangement such that removal of a bag draws open the next bag in the stack. While bonding adjacent bags in a stacked arrangement assists in opening adjacent bags, further improvements are possible.

There is a need in the art for an arrangement for dispensing plastic bags which is not only practical for transportation and display but also overcomes the inconveniences associated with bag retrieval and opening as described above. Ideally, the arrangement will reduce the possibility of contamination of bags before they are used.

SUMMARY OF THE INVENTION

A convenience package for thin film products according to aspects of the present invention places a folded stack of thin film plastic bags inside a container to protect the bags during shipping, handling and dispensing. The container surrounds the plastic bags and includes an opening through which individual bags are retrieved. The plastic bags are attached to each other in such a manner that retrieval of a first bag through the opening in the container partially retrieves a second bag and leaves part of the second bag protruding through the opening. Attachments between bags within the container ensure that each bag is opened as it is retrieved through the opening.

An aspect of the present invention relates to a particular configuration of stacked thin film bags. Each bag includes a sleeve-like body extending between an open first end and a closed second end. A heat-sealed bond across the bag body typically closes the second end. In the disclosed embodiments, the open end of the bag is connected to an upper root by a perforated connection, while the closed end of the bag is connected to a lower root by a perforated connection. The bags are arranged in a stack with the upper roots aligned over the upper roots of other bags in the stack and lower roots aligned over the lower roots of other bags in the stack. In the disclosed embodiment the upper and lower roots are bonded together. Each bag includes an outer layer which permits a bond to be formed between the outside layers of adjacent bags in the stack while leaving the inside layers of the bags free of each other. The outside layer may take the form of a plastic film having a lower melting temperature than the plastic film of the inside layer. Other means of achieving the bond such as adhesives are also possible. This bond between the outside layers of adjacent bags in the stack serves to draw a following bag through the opening of the container upon retrieval of the top bag in the stack.

According to aspects of the present invention, the stack of film bags is folded and the upper and lower roots are bonded together and to the container. This produces a compact package where the folded end of the folded stack is exposed through the opening in the container.

The container for the convenience package may be a flexible film package as illustrated, or a rigid reusable container. A flexible film package may provide the opening by perforating or weakening a seam around the opening. Upon removal of the container material over the opening, the folded end of the folded stack of bags is exposed through the opening. Grasping the top bag in the stack and pulling it through the opening breaks the perforated connections between the bag and its upper and lower roots. The outside layer of the back of the top bag in the stack is bonded to the outside layer of the front of the second bag in the stack. Removal of the top bag in the stack draws the front of the second bag away from its perforated connection to the upper root and through the opening. This movement opens the second bag in the stack and exposes a portion of the upper edge of the bag to facilitate removal. The strength of the bond between the outside surfaces of adjacent bags is sufficient to pull the front of the following bag through the opening, but configured to separate before breaking the lower perforated connection of the following bag. Thus, only a portion of the front rim of the following bag is exposed before retrieval. Bags are dispensed one at a time and in an open condition. The exposed portion of the bag facilitates removal.

DETAILED DESCRIPTION OF THE PREFERRED EMBODIMENT

Figure 1:
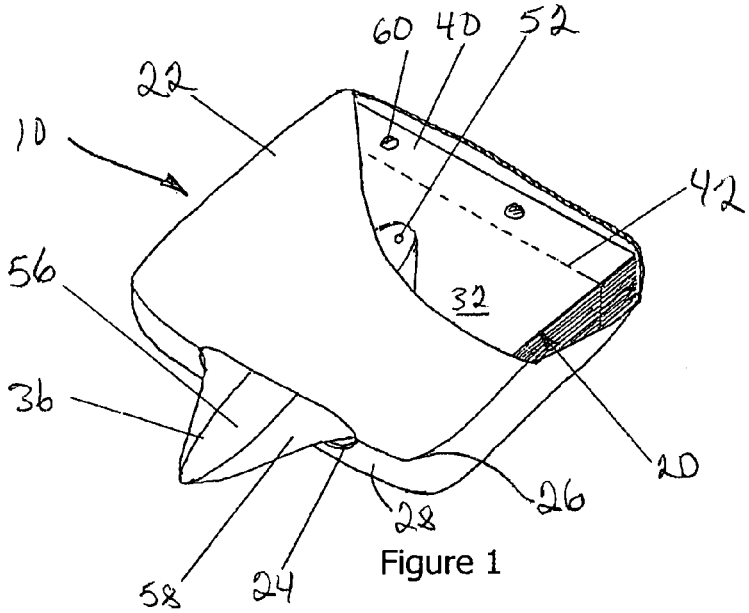
FIG. 1 is a cut away exterior view of an embodiment of a convenience package for thin film products according to aspects of the present invention.
Figure 2:
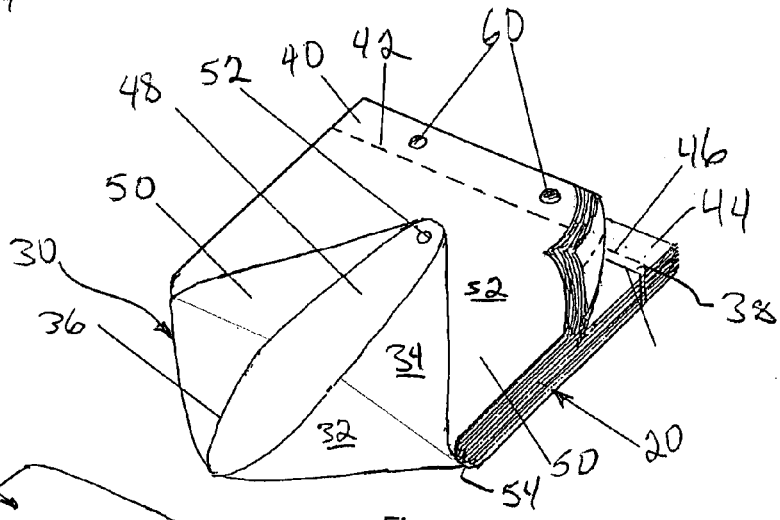
FIG. 2 is a top view of an embodiment of a folded stack of film bags compatible with the convenience package of FIG. 1.
Figure 3:
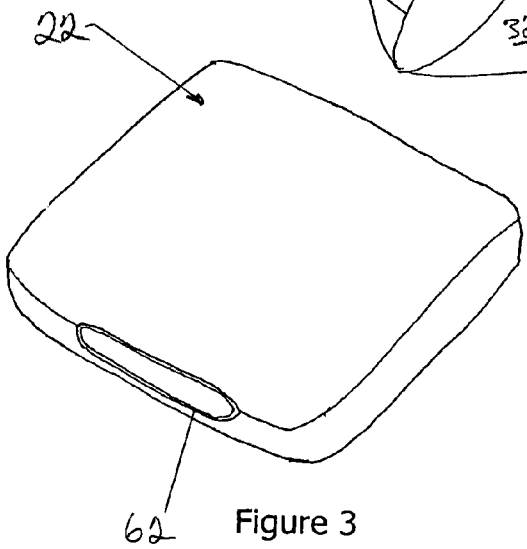
FIG. 3 is an outside view of an unopened convenience package for thin film products according to aspects of the present invention.

A preferred embodiment of a convenience package for thin film products is shown in FIGS. 1–3. The convenience package 10 includes a folded stack 20 of film bags surrounded by a container 22. The illustrated container 22 is constructed of a flexible plastic film. Other containers constructed of rigid plastic or other rigid materials are also compatible with the present invention. The container 22 is generally box-shaped and defines an opening 24 generally in the center and adjacent the top edge 26 of a side face 28 of a container. A flexible film container may provide the opening 24 by perforating or weakening a seam 62 around the opening as shown in FIG. 3. The folded stack 20 of film bags is placed inside the container 22. Each bag 30 includes a sleeve-like bag body having a front 32, a back 34, an open upper end 36, and a closed lower end 38. The open upper 36 end is connected to an upper bag root 40 by a perforated connection 42. The closed lower end 38 is connected to a lower bag root 44 by a second perforated connection 46. The film bags 30 include an inside layer 48 and an outside layer 50. A bond 52 is formed between the outside layers 50 of adjacent bags. The bond 52 is laterally centered between the side edges of the bags and located between the folded end 54 of the folded stack 20 and the perforated connection 42 between the open upper end 36 of the bag body and the upper bag root 40. The inside layers 48 of the bags 30 are left free of each other adjacent the bond 52.

As best shown in FIGS. 1 and 2, the back 34 of each bag in the stack is bonded to the front 32 of the following bag in the stack (except the bottom bag in the stack). Removal of a bag 30 through the opening 24 in the container breaks the perforated connections 46, 42 between the bag 30 and the lower and upper roots 40, 44, respectively. The bond 52 between bags is constructed to be weaker than the lower perforated connection 46 but stronger than the upper perforated connection 42. During removal of a bag 30 through the opening 24, the perforated connection between the bag 30 and the lower root 44 is broken first due to pulling force of the user. When the bond 52 between bags breaks, a portion 58 of an open bag is left protruding through the container opening 24. This configuration facilitates removal of individual open bags from the convenience package 10.

The bags 30 are arranged in a stack with the upper roots 40 and lower roots 44 aligned. The bond 52 between the outside layers 50 of the bags is formed prior to folding the stacked bags to form the folded stack 20. In the folded stack 20, the upper roots 40 are aligned with and over the lower roots 44. In the illustrated embodiment of the folded stack 20 the upper and lower roots 40, 44 are bonded together at points 60 and secured inside the container 22. This configuration is compact and keeps the bags 30 neatly organized within the convenience package 10. Bags are secured to the folded stack 20 by the perforated connections 42, 46 at the upper and lower roots 40, 44. This configuration ensures that only one bag at a time is removed. Bags are opened by removal of the preceding bag as shown in FIGS. 1 and 2 and described above. The container 22 protects the stacked thin film bags during transportation and use.

While a preferred embodiment of the foregoing invention has been set forth for purposes of illustration, the foregoing description should not be deemed a limitation of the invention herein. Accordingly, various modifications adaptations and alternatives may occur to one skilled in the art without departing from the spirit and the scope of the present invention.

What is claimed is:

1. A dispensing arrangement of plastic bags, each plastic bag comprising:

a sleeve body extending between an open first end and a closed second end, said sleeve body having inside and outside layers, a front and a back;

an upper root joined to said sleeve body first end by a first perforated connection; and a lower root joined to said second end by a second perforated connection, said dispensing arrangement comprising:

a plurality of said plastic bags arranged in a stack with the upper root of each bag in the stack aligned with and secured to the upper root of the other bags in the stack and the lower root of each bag in the stack aligned with and secured to the lower root of the other bags in the stack, said stack having a top bag and a bottom bag, the outside surface of the back of each bag in the stack being joined at a bond to the outside surface of the front of each adjacent bag in the stack except the bottom bag, said stack being folded to form a folded stack in which said upper and lower roots are opposite a folded side of said bags, said bottom bag being within and said top bag being on the outside of said folded stack; and a container surrounding said folded stack, said upper and lower roots being secured within said container and said folded side of said bags being exposed through an opening in said container.

2. The arrangement for dispensing bags of claim 1, wherein removal of said top bag through said opening breaks said first and second perforated connections between the top bag and the upper and lower root of the top bag and said bond between the outside surface of the back of the first bag and the outside surface of the front of a following bag pulls the front of the following bag through said opening, partially breaking the first perforated connection between the front of the following bag and the upper root of the following bag.

3. The arrangement for dispensing bags of claim 1, wherein each said bag includes handles.

4. The arrangement for dispensing bags of claim 1, wherein said bond is located substantially laterally centered on said front and back sides of said sleeve.

5. The arrangement for dispensing bags of claim 1, wherein said bond has a breaking strength greater than a breaking strength of said first perforated connection and less than a breaking strength of said second perforated connection.

6. The arrangement for dispensing bags of claim 1, wherein said bond is located between said folded side and said first perforated connection.

7. The arrangement for dispensing bags of claim 1, wherein said container is constructed of flexible plastic film.

8. The arrangement for dispensing bags of claim 1, wherein said container is rigid.

9. The arrangement for dispensing bags of claim 1, wherein said upper and lower roots are joined to each other and to the container.

* * * * *